United States Patent [19]

Kniskern

[11] 4,025,744

[45] May 24, 1977

[54] SHOCK AND VIBRATION SENSITIVE SWITCH

[75] Inventor: Leroy James Kniskern, Christiansburg, Va.

[73] Assignee: Litton Systems, Inc., Beverly Hills, Calif.

[22] Filed: Mar. 29, 1976

[21] Appl. No.: 671,091

[52] U.S. Cl. ..... 200/61.45 R; 200/61.93; 200/277

[51] Int. Cl.² ..... H01H 35/14; H01H 1/12

[58] Field of Search ..... 200/61.45 R, 61.48–61.53, 200/275, 277, 61.93; 340/261; 102/70.2 R

[56] References Cited

UNITED STATES PATENTS

| | | | |
|---|---|---|---|
| 2,938,461 | 5/1960 | Rabinow | 102/70.2 R |
| 3,522,395 | 7/1970 | Clarke | 200/61.45 R |
| 3,527,906 | 9/1970 | Schwab | 200/61.45 R UX |
| 3,552,768 | 1/1971 | Kaiser | 200/61.45 R X |
| 3,671,690 | 6/1972 | Parlato | 200/61.45 R |
| 3,735,072 | 5/1973 | Six, Jr. | 200/61.45 R |

FOREIGN PATENTS OR APPLICATIONS

| | | | |
|---|---|---|---|
| 1,533,242 | 6/1968 | France | 200/61.45 R |
| 1,296,679 | 6/1969 | Germany | 200/61.52 |

*Primary Examiner*—James R. Scott
*Attorney, Agent, or Firm*—M. Michael Carpenter

[57] ABSTRACT

A shock and vibration sensitive switch is shown constructed from a toroidally shaped disc having a conductive outer periphery supported by sharp, film-penetrating contacts mounted in an insulated housing. The switch may be used in a security system which is energized by the shock and vibration accompanying an unauthorized entry to trigger an alarm. The insulated housing is wafer-shaped and mounts C-shaped contacts that permit the sensor to be unobtrusively mounted in either direction, which contributes to the security of the system.

10 Claims, 4 Drawing Figures

SHOCK AND VIBRATION SENSITIVE SWITCH

BACKGROUND OF THE INVENTION

The present invention relates to an electrical switch and, more particularly, to an electrical switch which utilizes a toroidally shaped disc to respond to shock and vibration for opening a normally closed circuit.

Shock and vibration sensors utilizing a spherical or toroidal mass are well known. One early arrangement patented in Germany in 1912 utilizes a conductive sphere mounted upon three conductive contacts arranged to support the sphere in the manner of a tripod, see German Pat. No. 262,949, granted Apr. 24, 1912. This idea was varied in a later patent which used three conductive legs having curved ends to support the sphere, see U.S. Pat. No. 3,560,680, which issued Feb. 2, 1971. Tests run on sensors constructed according to the arrangements shown in the two references cited above produce an unacceptable number of switch failures. It is believed that a conductive film builds up over a period of time on the conductive surface of the sphere. In the presence of the film, the application of shock or vibration to the sensor may produce an undesired indication because the switch either does not open or opens and fails to close. It has been found that rounded contacts will not penetrate the film build-up upon the conductive sphere. Another disadvantage of the tripod support is its unidirectional mounting requirement. In a security system, there are applications in which it is desirable to mount the sensor in an upside-down position in order to hide its wiring. A sensor using a tripod supported shpere will not function in an upside-down mounting arrangement.

In addition to switches using a spherically shaped mass, it is also known to utilize a toroidally shaped mass to provide sensitivity. For example, see U.S. Pat. Nos. 3,522,395; 3,527,906 and 3,671,690. The switches shown in these patents are generally used for sensing shock generated by an impact force or a centrifugal force.

After considering the prior art and testing many of the devices available, it became apparent that a shock and vibration sensor to be utilized in a security system or a burglar alarm could sit idly by for several months and perhaps years before being required to perform its task. The prior art sensors do not take into account the tendency of any conductive surface, including a gold surface, to accumulate a non-conductive film. Further, many prior art sensors allow the conductive mass to contact the plastic housing which contact deposits minute particles of plastic upon the surface. It is possible for the switch to open and, because of the film or accumulated particles, not close again. In a security system that counts a number of alarm conditions prior to triggering an alarm mechanism to prevent false alarming, such as shown in U.S. Pat. Nos. 3,733,598 and 3,774,190, a faulty switch renders the system inoperative.

SUMMARY AND OBJECTS OF THE INVENTION

Accordingly, one object of the present invention is to provide a shock and vibration sensitive switch which will reduce the build-up of a non-conductive film upon a conductive surface and, if such a film should build up, which will penetrate that film.

Sensors utilizing a sphere are often too sensitive to low-force, low-frequency disturbances; while sensors utilizing a toroidal mass often require high-force disturbances. Thus, another object of the present invention is to provide a shock and vibration sensor which is less sensitive to low-force, low-frequency disturbances yet sensitive enough to provide the suitable sensor for a security system.

A further object of the present invention is to provide a shock and vibration sensitive switch with a thin, unobtrusive package that can be mounted in more than one direction through the use of a threaded fastener or bonding material.

A still further object of the present invention is to provide an economical sensor which may be factory assembled from a few parts for easy field installation.

A final object of the invention is to provide a sensor with a toroidally shaped disc which is mounted within an insulated housing by a support sleeve to prevent the conductive surface of the disc from contacting any portion of the housing but for the conductive contacts mounted therein.

In accomplishing these and other objects, there is provided an insulated housing with a center post for supporting a toroidally shaped disc on the inner periphery thereof. Contacts are mounted in the housing for contacting the conductive outer periphery of the toroidal disc which is prevented from contacting the housing by the interaction of the center post and inner periphery. The contacts are provided with sharp ends or corners to penetrate any film accumulated on the conductive periphery of the disc.

Other objects and advantages of the present invention will become apparent to those skilled in the art after careful consideration of the specification and the drawings, wherein:

DESCRIPTION OF THE PREFERRED EMBODIMENT

Figure 1:
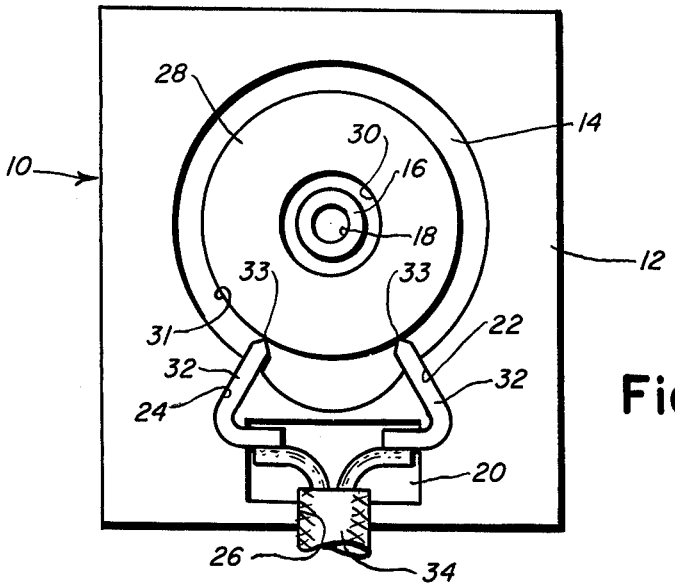
FIG. 1 is a front elevation showing a shock and vibration sensitive switch of the present invention with its cover removed.

Referring now to the drawings, FIG. 1 shows a shock and vibration sensitive switch 10 constructed from a generally square and flat housing 12 that may be molded from a plastic material, such as acetal. The housing 12 is provided with a centrally located cylindrical chamber 14 having a center post 16 with a mounting aperture 18 passing through the axis thereof. Located below the cylindrical chamber 14 is a wire receiving chamber 20 having right and left-hand contact channels 22 and 24 communicating with the cylindrical chamber 14 and a wire passage 26 communicating with the outside edge of the housing 12.

A toroidally shaped disc 28 mounts within the cylindrical chamber 14 having an inner aperture 30 which clears the center post 16 and a conductive outer periphery 31. L-shaped contacts 32, provided with sharp upper ends 33, are mounted within the right and left-hand contact chambers 22 and 24 supporting the toroidal disc 28 by contacting its conductive periphery 31 which may be made highly conductive by gold plating. The sharp tips 33 of the L-shaped contacts 32 may also be gold plated. Each contact 32 is connected to a wire within a two-wire cable 34. To complete the sensor 10, a housing cover 36, FIG. 3, which may be made from a molded acetal like the housing, is attached to the housing 12 as by ultrasonic welding.

The assembled switch 10 shown in FIG. 1 is arranged with the inner diameter of cylinder 14 large enough to clear the conductive surface 31 of the toroidal disc 28 when the outer diameter of post 16 contacts the inner diameter of aperture 30. Thus, it will be seen that the only contact which the conductive surface 31 of the toroidal disc 28 can make is contct with the sharp points 33 of the L-shaped contacts 32. This arrangement prevents the conductive surface 31 from accumulating foreign matter, such as particles of the molded housing 12. The toroidal disc 28 is sized to ensure that its mass will be sufficient to enable the sharp points 33 of the L-shaped contacts 32 to penetrate any additional film which might build up on the conductive surface 31 thereof. The sensor of FIG. 1 is limited in that it must be mounted with its cable 34 extending from its lower surface.

Figure 2:
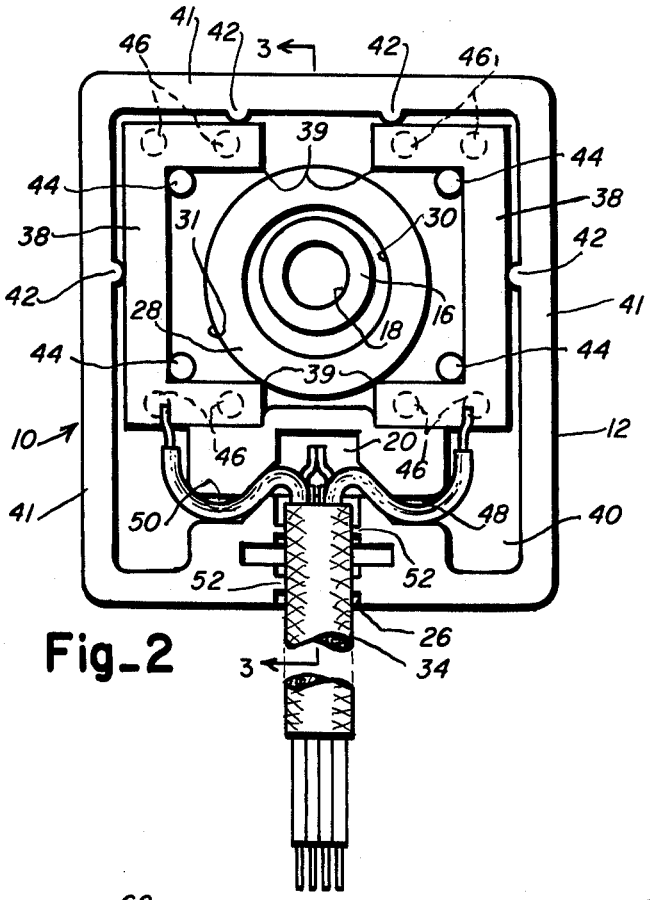
FIG. 2 is a front elevation, similar to FIG. 1, showing contacts which allow the switch to be mounted in two directions.
Figure 3:
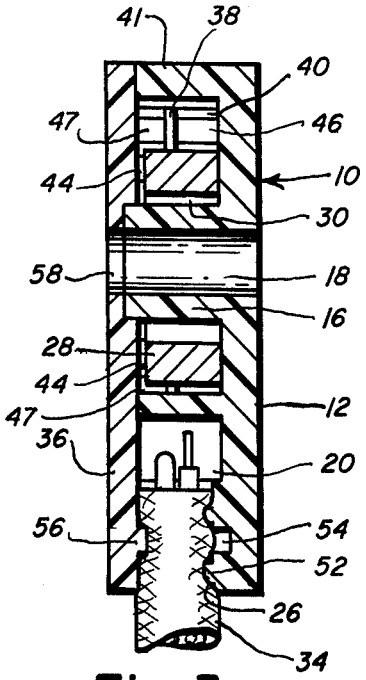
FIG. 3 is a cross-sectional view taken along lines 3—3 of FIG. 2.

A second embodiment of the switch 10 is shown in FIGS. 2 and 3 in which the contacts are specially configured C-shaped contacts 38 having sharp upper and lower inner end corners 39 for contacting the conductive surface 31 of the toroidally shaped disc 28. The housing 12 is formed with a large, generally square chamber 40 having side walls 41 with semi-circular columns 42 located thereon. Posts 44 extend from the floor of the housing chamber 40 to a height equal to the height of the side walls 41 for contacting the inner corners of the C-shaped contacts 38 and locating these contacts against columns 42 within the housing 12. A second set of posts 46 extends from the floor of housing chamber 40 to a lesser height for locating the height of the C-shaped contacts 38 within the chamber 40. The cover 36 is provided with posts 47 which extend down into chamber 40 to abut the contacts 38 above posts 46 for locking the contacts 38 into the position shown once the cover is attached.

In the embodiment of FIGS. 2 and 3, the wire cable 34 comprises a four-wire cable which passes through the wire passage 26 into the wire chamber 20 where two of the four wires are joined together, as by welding. A right and left-hand passage 48 and 50 provides a clearance passage for each of the remaining four wires to pass into the square chamber 40 where they are respectively attached to one of the C-shaped contacts 38, as by welding. Extending from the surface of the wire passage 26 are a series of ferrules 52 which act as a strain relief for the wire cable 34. The wire passage 26 is further provided with a semi-circular relief 54, while the housing cover 36 is provided with a ridge 56 for forcing the wire cable 34 into the relief 54 and further retaining the cable in the assembled switch 10.

As in FIG. 1, the toroidal disc 28 of FIG. 2 is restrained from contacting all but the inner corners 39 of the C-shaped contacts 38 by the outer surface of the center post 16 and its contact with the aperture 30. As best seen in FIG. 3, the housing cover 36 is provided with an aperture 58 which is aligned with the mounting aperture 18. The apertures 18 and 56 are utilized as a clearance hole for a threaded fastener which conveniently mounts the switch to a desired support in any direction.

Figure 4:
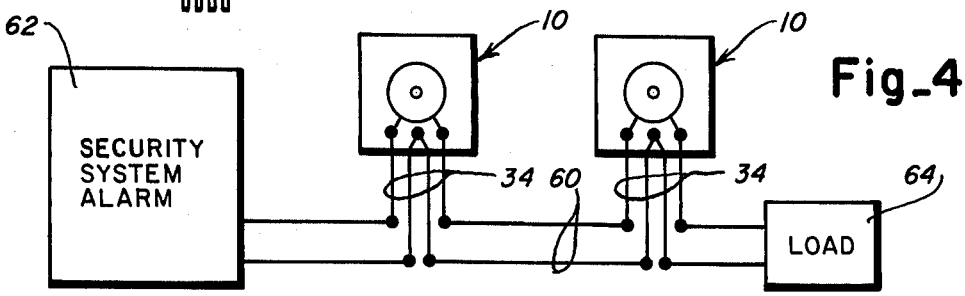
FIG. 4 is a schematic diagram illustrating the electrical connection of the switch within a typical security system.

The four conductors in cable 34 permit easy installation of the sensor 10 into a two-conductor cable 60, as seen in FIG. 4 To install the sensors 10, the two-wire cable 60 is run about the premises to be equipped with a security system alarm 62. Once the cable 60 has been run, the sensor switches 10 can be easily installed by cutting the cable and splicing two of the four wires to one end of the severed cable while splicing the remaining two wires to the other end. For some systems, it may be desirable to terminate cable 60 at a load 64. Thus, it will be seen that the four-wire cable 34 connected to the two-wire cable 60 greatly simplifies the installation of the switches 10. Further, the C-shaped configuration of contacts 38 allows the cable 34 to extend from the upper or lower surface of housing 12. In this way, the sensor may be unobtrusively installed through the utilization of a single threaded fastener or bonding material to any convenient surface. The flat, thin configuration of the housing also lends to its unobtrusive installation.

The sensor thus described includes but five parts, including housing 12, disc 28, two contacts 32 or 38, to which a wire cable 34 is factory installed prior to the factory attachment of the last part, the cover 36. The factory assembly of these few parts provides an economical sensor 10 which may be easily installed in a security system. Other systems in which the sensor may be utilized and other variations of the sensor will become apparent to those skilled in the art.

The embodiments of the invention in which an exclusive property or privilege is claimed are defined as follows:

1. A shock and vibration sensitive switch, comprising:

a toroidally shaped disc having an inner periphery and a conductive outer periphery;

a housing having side walls and a center post for contacting said inner periphery of said disc, wherein the contact therewith prevents said conductive outer periphery of said disc from contacting said housing side walls; and a pair of contacts mounted in said housing for supporting said conductive outer periphery of said disc to close a circuit therebetween which opens when said wsitch is subjected to shock and vibration.

2. A shock and vibration sensitive switch as claimed in claim 1, wherein said pair of contacts are sharp pointed and the mass of said disc is sufficient to permit said contact of said conductive outer periphery by said sharp pointed contacts to penetrate any undesirable nonconductive film which may accumulate on said conductive outer periphery of said disc.

3. A shock and vibration sensitive switch as claimed in claim 1, wherein said pair of contacts are L-shaped and symmetrically arranged with sharp pointed ends that support said disc.

4. A shock and vibration sensitive switch as claimed in claim 1 wherein said pair of contacts are C-shaped and surround said toroidally shaped disc to contact said conductive outer periphery thereof from more than one direction whereby said switch may be mounted in more than direction.

5. A shock and vibration sensitive switch as claimed in claim 1, wherein said center post of said housing is tubular for receiving a mounting fastener therethrough for mounting said switch housing.

6. A shock and vibration sensitive switch, comprising:

a flat, disc-shaped mass having a conductive outer periphery;

a housing;

a pair of C-shaped conductive contacts oppositely mounted in said housing each having two ends confronting one another with one opposing pair of said confronting ends contacting said conductive outer periphery of said mass when said housing is oriented in one direction and another opposing pair of said confronting ends contacting said conductive outer periphery when said housing is oriented in another direction, for closing a circuit between said contacts which opens when said switch is subjected to shock and vibration.

7. A shock and vibration sensitive switch as claimed in claim 6 wherein said disc-shaped mass is toroidally shaped and said housing has a tubular supporting post passing through the center of said toroidally shaped mass for mounting said housing.

8. A shock and vibration sensitive switch as claimed in claim 6 wherein each of said pair of C-shaped conductive contacts have sharp inner corners on said two ends confronting one another to penetrate any non-conductive film on said conductive outer periphery of said mass.

9. A shock and vibration sensitive switch as claimed in claim 6; additionally comprising:

a cable;

said housing having a wire receiving chamber for receipt of said cable; and a housing cover to retain said cable, mass and contacts in said housing.

10. A shock and vibration sensitive switch as claimed in claim 6; additionally comprising a four-conductor cable passing into said housing and having two conductors joined together in said housing and two further conductors each joined to said pair of C-shaped conductive contacts.

* * * * *